US011571596B2

(12) United States Patent
Altizer

(10) Patent No.: US 11,571,596 B2
(45) Date of Patent: Feb. 7, 2023

(54) FIRE ARRESTER AND FIRE RESISTANT STRUCTURE OF A FIRE SAFETY CABINET

(71) Applicant: M10 Trading Limited, Taipa (MO)

(72) Inventor: John Altizer, Taipa (MO)

(73) Assignee: M10 Trading Company, Taipa (MO)

( * ) Notice: Subject to any disclaimer, the term of this patent is extended or adjusted under 35 U.S.C. 154(b) by 197 days.

(21) Appl. No.: 16/749,205

(22) Filed: Jan. 22, 2020

(65) Prior Publication Data

US 2020/0246649 A1 Aug. 6, 2020

(51) Int. Cl.

| | |
|---|---|
| ***A62C 4/00*** | (2006.01) |
| ***A47B 81/00*** | (2006.01) |
| ***E05G 1/02*** | (2006.01) |
| ***E05G 1/024*** | (2006.01) |

(52) U.S. Cl.

CPC ..... *A62C 4/00* (2013.01); *A47B 81/00* (2013.01); *E05G 1/024* (2013.01)

(58) Field of Classification Search

CPC ..... B65D 90/325; B65D 90/32; B65D 37/32; A62C 4/00; A47B 81/00; E05G 1/024; E05G 1/026; E05G 1/02

USPC ..... 220/88.2, 88.4, 560.01, 592.27, 592.21, 220/592.2; 312/409, 400

See application file for complete search history.

(56) References Cited

U.S. PATENT DOCUMENTS

| | | | | |
|---|---|---|---|---|
| 223,377 A * | 1/1880 | Newton | B65D 25/385 | 222/189.01 |
| 964,048 A * | 7/1910 | McNutt | F16L 9/02 | 220/88.2 |
| 1,755,624 A * | 4/1930 | Yount | A62C 4/00 | 220/88.2 |
| 2,376,933 A * | 5/1945 | Moran | F01N 3/06 | 220/88.2 |
| 4,767,016 A * | 8/1988 | Cook, Jr. | B65D 55/02 | 222/189.01 |
| 2013/0206759 A1* | 8/2013 | Wurz | A62C 3/00 | 220/88.2 |
| 2016/0346575 A1* | 12/2016 | Hong | A62C 4/02 | |

FOREIGN PATENT DOCUMENTS

| | | | | |
|---|---|---|---|---|
| GB | 2576832 A * | 3/2020 | A62C 4/02 | |

* cited by examiner

*Primary Examiner* — Robert J Hicks

(74) *Attorney, Agent, or Firm* — Armstrong Teasdale LLP

(57) ABSTRACT

A fire resistant structure includes a bottom plate and a cover plate connected together, a heat insulation layer between the bottom plate and the cover plate, wherein the bottom plate includes a fire prevention opening, the fire prevention opening having a fire prevention opening cover nut, wherein one side of the fire prevention opening near the heat insulation layer is provided with a fire prevention opening filter, the fire prevention opening filter connected to the bottom plate. A fire arrester is provided on the cover plate, the fire arrester includes a fire arrester shell, an accommodating cavity provided therein, a fire blocking core in the accommodating cavity, and a connection portion extending from one end of the fire arrester shell, wherein a plurality of connection holes are provided on the connection portion. An end face of the fire blocking core is flush with an end face of the connection portion.

6 Claims, 3 Drawing Sheets

FIRE ARRESTER AND FIRE RESISTANT STRUCTURE OF A FIRE SAFETY CABINET

CROSS-REFERENCE TO RELATED APPLICATIONS

This application claims priority to Chinese Patent Application No. 201910094413.3, filed Jan. 31, 2019, the disclosure of which is hereby incorporated herein by reference in its entirety.

TECHNICAL FIELD

The present invention relates to the field of fire arresters, in particular to a fire arrester and a fire-resistant structure of a fire safety cabinet.

BACKGROUND ART

A fire safety cabinet is a storage cabinet with an antistatic design and a fire protection function which provides safe storage, packaging and classified management of hazardous chemicals. The main functions of fire safety cabinet equipment are as follows: 1) different sizes and types of fire safety cabinets can provide safe storage, packaging and classified management of hazardous chemicals; and 2) different sizes of fire and explosion-proof cabinets can provide safe storage of combustible and flammable liquids and chemicals. Chemical storage cabinets can be placed in the workplace to store combustible, flammable and other organic solvents, eliminating the need to go to a special dangerous goods storage room.

The main functions of chemical fire safety cabinets are as follows: 1) they can prevent fires, and the leak tank can prevent accidental liquid leakage from overflowing the chemical fire safety cabinet; 2. they can save human life, property and environment; 3) they can reduce costs and improve work efficiency; because of its small size, it can be placed in the workplace to store flammable and explosive materials without having to frequently go to a special dangerous goods storage room, thus saving time and effort; 4) they can provide effective management of various dangerous goods; the safety cabinets of different colors may have different functions, and store different chemicals, the chemicals can be in different categories for easy management at a glance; and 5) in the process of storing chemicals, colored labels may be used to identify, sort, and separate various flammable or dangerous liquids, which will also make it easier for firefighters to identify dangerous materials in the event of a fire.

The fire safety cabinets in the prior art generally include a bottom plate and a cover plate. There is a certain distance between the bottom plate and the cover plate in order to prevent the temperature from rising rapidly within the cabinet, which may make the temperature in the cabinet reach the ignition point. Due to the volatile nature of chemicals, the chemical concentration in the cabinet will rise, which could easily poison people using it. Therefore, ventilation openings are generally provided on one or more sides of the cabinet to better maintain ventilation and exhaust the hazardous gases. During testing and use, it has been found that the fire safety cabinet of this structure is short of the fire rating requirements. In the event of a fire, the temperature of the ventilation openings is likely to increase rapidly, which may accelerate the ignition rate, cause chemicals to burn or explode, which is extremely dangerous and may seriously threaten the workplace and personal safety.

Therefore, it is necessary to design a fire arrester and a fire safety cabinet fire resistant structure to solve the above technical problems.

SUMMARY OF INVENTION

In view of the deficiencies in the prior art, the present invention provides a fire arrester with stable fire resistance, simple structure, easy disassembly and easy maintenance.

The present invention also provides a resistant structure of a fire safety cabinet with high fire rating and good fire blocking effect.

The technical solution employed by the present invention is as follows:

A fire arrester is provided, the fire arrester includes a fire arrester shell in a cylindrical shape, an accommodating cavity is provided therein, a fire blocking core is provided in the accommodating cavity, a connection portion is bent and extended at one end of the fire arrester shell, and a plurality of connection holes are provided on the connection portion at an interval, and an end face of the fire blocking core is flush with an end face of the connection portion.

Preferably, one side of the fire blocking core is provided with a saved space, and the saved space is arranged on the accommodating cavity.

Preferably, the fire blocking core is a corrugated plate.

Another technical solution of the present invention is as follows:

A fire resistant structure of a fire safety cabinet is provided, the fire resistant structure includes: a bottom plate and a cover plate connected to the bottom plate, a heat insulation layer is provided between the bottom plate and the cover plate, the bottom plate is provided with a fire prevention opening thereon, the fire prevention opening is provided with a fire prevention opening cover nut, one side of the fire prevention opening near the heat insulation layer is provided with a fire prevention opening filter, the fire prevention opening filter is connected to the bottom plate, and a fire arrester is provided on the cover plate.

Preferably, the connection portions are fixedly connected with the cover plate, and the cover plate is provided with positioning holes corresponding to the connection holes.

Preferably, the fire prevention opening filter is located in the saved space, and the fire prevention opening filter is not in contact with the fire blocking core.

The beneficial effects of the present invention are as follows:

When the fire arrester is used in a fire safety cabinet, compared with the fire safety cabinet which is provided with a fire suppression device at its fire prevention opening available in the prior art, the structure of the present invention is simple, and the fire resistance core is installed on the flame arrester shell, which has easy disassembly and maintenance, and relatively low cost.

One end face of the fire arrestor is flush with an end face of the connection portion. When the cabinet is on fire, this feature can effectively prevent the flame from entering the fire arrester shell or going from a gap between the fire arrester shell and the fire safety cabinet to the outside of the fire safety cabinet.

The fire arrester is installed at the fire prevention opening, which can not only meet the requirements of ventilation and exhaust, but also have a high level of flame resistance and good flame resistance performance. It can effectively prevent the spread of the flames of flammable gas and liquid, and prevent the fire from causing an explosion.

The fire prevention opening filter is disposed in a saved space to prevent the temperature of the fire prevention opening from being quickly transmitted to the thermal insulation layer, which can delay the time of fire or explosion of the chemicals in the fire safety cabinet. In addition, the fire prevention opening filter does not contact the fire blocking core, this can prevent the fire blocking core from blocking the through holes of the fire prevention opening filter, ensure the effective ventilation and exhaust, and leave a gap between the fire prevention opening filter and the fire blocking core, which similarly play a role in delaying the temperature transmission and the time of fire or explosion.

Figure 1:
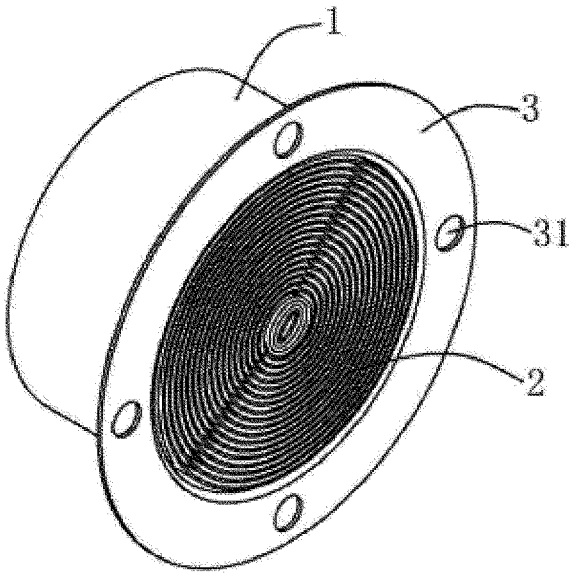
FIG. 1 is a schematic view of the three-dimensional structure of the fire arrester according to the present invention.

Description of element symbols: fire arrester shell 1; accommodating cavity 11; saved space 111; fire blocking core 2; connection portion 3; connection hole 31; bottom plate 4; fire prevention opening 41; cover plate 5; positioning hole 51; insulation layer 6; fire prevention opening cover nut 7; fire prevention opening filter 8.

DESCRIPTION OF EMBODIMENTS

In order to make the technical problems, technical solutions, and advantages to be solved by the present invention clearer, the following describes in detail with reference to the accompanying drawings and specific embodiments.

Figure 2:
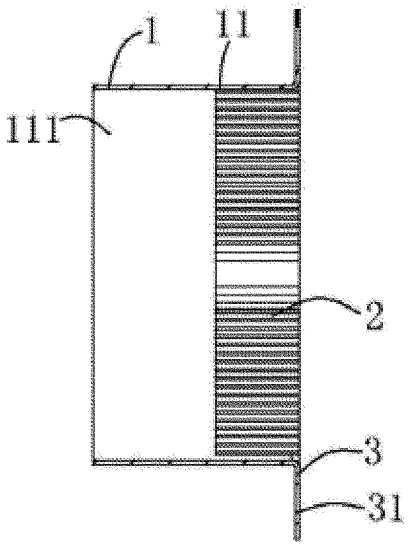
FIG. 2 is a sectional view of a fire arrester according to the present invention.

As shown in FIG. 1 and FIG. 2, a fire arrester is provided. The fire arrester includes a fire arrester shell 1 in a cylindrical shape, an accommodating cavity 11 is provided therein, a fire blocking core 2 is provided in the accommodating cavity 11, a connection portion 3 is bent and extended at one end of the fire arrester shell 1; the fire arrester shell 1 and the connection portion 3 are integrally formed. Compared with the prior art fire arrester, the structure provided herein is simpler, the processing is convenient, and the processing steps, time and material costs are reduced. A plurality of connection holes 31 are provided on the connection portion 3 at an interval, the plurality of connection holes 31 make it convenient for fixed installation of the fire arrester. When the fire arrester is installed, the connection portion 3 is fixed on the outer side of the cover plate 5 so as to reduce the gap between the connection portion 3 and the cover plate 5, and the resulting fire prevention effect is better. An end face of the fire blocking core 2 is flush with an end face of the connection portion 3, which effectively prevents flames from entering the accommodating cavity 11 and extending to the inside or outside.

As shown in FIG. 2, a saved space 111 is provided on a side portion of the fire blocking core 2, the saved space 111 is located on the accommodating cavity 11. One side of the accommodating cavity 11 is provided with a fire blocking core 2, and the other side thereof is the saved space 111. The purpose thereof is to allow the fire arrester shell 1 and the fire prevention opening 41 of the fire cabinet to form a cavity to reduce the communication gap between the fire prevention opening 41 and the heat insulation layer 6, and reduce the heat transfer efficiency.

In this embodiment, the fire blocking core 2 is a corrugated plate, which can effectively prevent the spread of the flames of flammable gas and liquid, and prevent an explosion caused by backfire.

Figure 3:
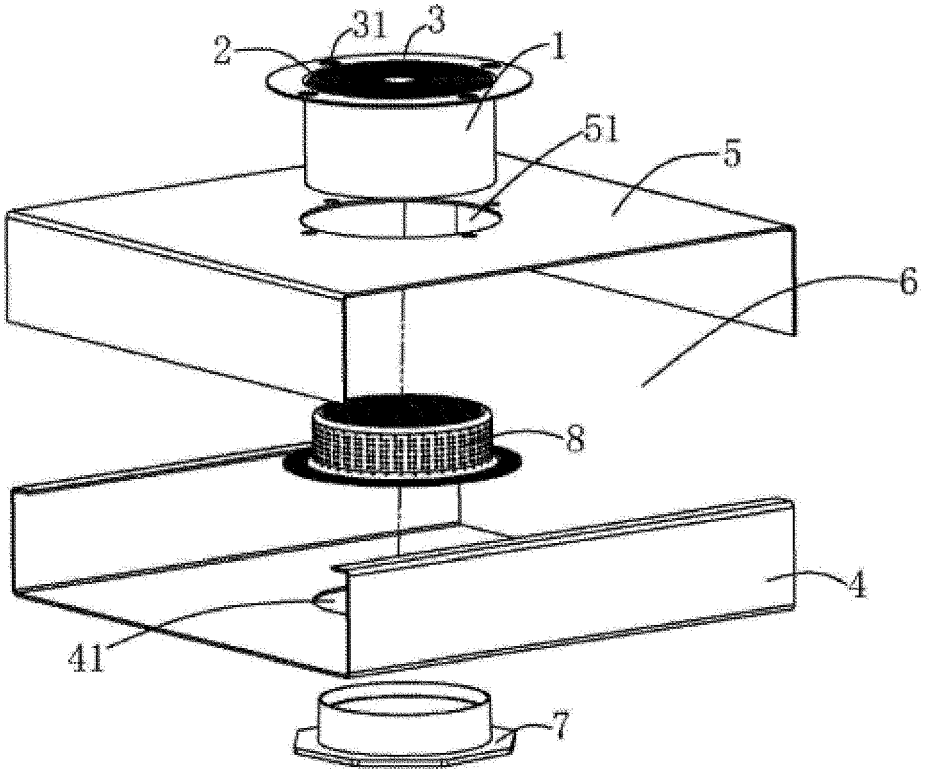
FIG. 3 is an exploded perspective view of the present invention.

As shown in FIG. 3, another technical solution is further provided. A fire resistant structure of a fire safety cabinet includes a bottom plate 4 and a cover plate 5 connected to the bottom plate, a heat insulation layer 6 is provided between the bottom plate 4 and the cover plate 5. Because flammable and explosive chemicals are stored in the fire safety cabinet, the heat insulation layer 6 can prevent the temperature in the fire safety cabinet from rising rapidly. In the event of a fire, the fire in the fire cabinet can be delayed to gain more time to extinguish the fire.

In this embodiment, preferably, the bottom plate 4 is provided with a fire prevention opening 41, an inner side of the holes of the fire prevention opening 41 is provided with a thread, in addition, the fire prevention opening 41 is further provided with a fire prevention opening cover nut 7, the fire prevention opening cover nut 7 is fixedly connected with the fire protection opening 41 so as to strengthen the connection strength. In addition, the fire prevention opening cover nut 7 plays a role to enhance the strength of the bottom plate 4.

In this embodiment, preferably, the fire protection opening 41 is used for ventilation and exhaust to prevent gas or liquid from leaking, which may result in high concentration in the cabinet, and people are easily poisoned when opening the fire safety cabinet.

In this embodiment, it is preferable that a fire prevention opening filter 8 be provided on a side of the fire protection opening 41 near the heat insulation layer 6. The fire prevention opening filter 8 can prevent external impurities from entering the fire safety cabinet. The fire prevention opening filter 8 is connected to the bottom plate 4 so as to fix the fire prevention opening filter 8. The cover plate 5 is provided with a fire arrester as mentioned above. At the same time, the fire prevention opening filter 8 can prevent external impurities from blocking the fire arrester which may damage the fire retarding function of the fire arrester. This embodiment is provided with a fire arrester, which can meet the ventilation and exhaust requirements, can reach a high level of fire resistance and good fire resistance performance; moreover, this can effectively prevent the spread of the flames of flammable gas and liquid, and prevent the explosion caused by backfire.

As shown in FIG. 3, the connection portion 3 is fixedly connected to the cover plate 5, and the cover plate 5 is further provided with positioning holes 51 corresponding to the connection holes 31 to facilitate the disassembly and assembly.

Figure 4:
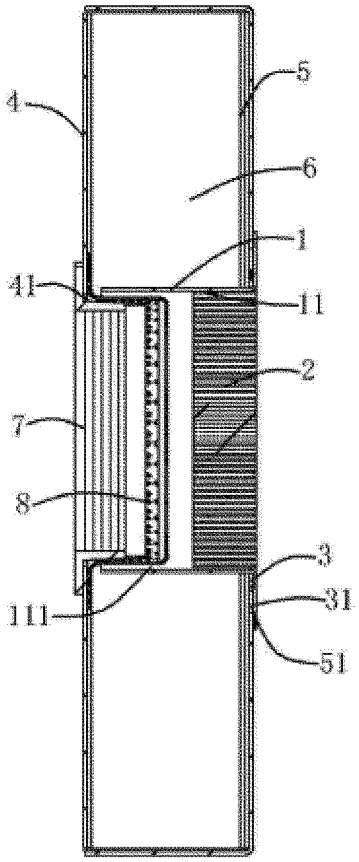
FIG. 4 is a sectional view of the present invention.

As shown in FIG. 4, the fire prevention opening filter 8 is located in the saved space 111, the fire prevention opening filter 8 is not in contact with the fire blocking core 2 to prevent the temperature of the fire protection opening 41 from being quickly transferred to the heat insulation layer 6. This can delay the time of fire or explosion of the chemicals in the fire safety cabinet, and also prevent the fire blocking core 2 from blocking the through holes of the fire prevention opening filter 8, so as to ensure effective ventilation and exhaust. Further, a gap is left between the fire prevention opening filter 8 and the fire blocking core 2, which plays a role to delay the temperature transmission or flame spreading time.

The present invention has stable fire resistance, simple structure, easy disassembly and assembly, simple maintenance, high fire protection level and good fire resistance effect.

Although the present invention has been described in detail with reference to the above embodiments, it will be apparent to a person skilled in the art from this disclosure that various changes or modifications can be made to the present invention without departing from the principle and spirit of the present invention as defined by the claims. Therefore, the detailed description of the embodiments of the present disclosure is only for explanation, and is not intended to limit the present invention. The scope of protection is defined by the content of the claims.

What is claimed is:

1. A fire arrester comprising:

a fire arrester shell in a cylindrical shape, an accommodating cavity provided in the arrester shell, a fire blocking core in the accommodating cavity, a connection portion extending from one end of the fire arrester shell, and a plurality of connection holes are provided on the connection portion at an interval, and an end face of the fire blocking core is flush with an end face of the connection portion.

2. The fire arrester according to claim 1, wherein one side of the fire blocking core is provided with a saved space, and wherein the saved space is arranged on the accommodating cavity.

3. The fire arrester according to claim 1, wherein the fire blocking core is a corrugated plate.

4. A fire resistant structure of a fire safety cabinet, comprising:

a bottom plate and a cover plate connected to the bottom plate, a heat insulation layer provided between the bottom plate and the cover plate, the bottom plate is provided with a fire prevention opening thereon, the fire prevention opening is provided with a fire prevention opening cover nut, one side of the fire prevention opening near the heat insulation layer is provided with a fire prevention opening filter, the fire prevention opening filter is connected to the bottom plate, and the fire arrester according to claim 1 is provided on the cover plate.

5. The fire resistant structure of a fire safety cabinet according to claim 4, characterized in that the connection portion is fixedly connected with the cover plate, and the cover plate is provided with positioning holes corresponding to the connection holes.

6. The fire resistant structure of a fire safety cabinet according to claim 4, wherein one side of the fire blocking core is provided with a saved space, and wherein the saved space is arranged on the accommodating cavity, characterized in that the fire prevention opening filter is located in the saved space, and the fire prevention opening filter is not in contact with the fire blocking core.

* * * * *